US006109585A

United States Patent [19]

Burch, Jr.

[11] Patent Number: 6,109,585

[45] Date of Patent: Aug. 29, 2000

[54] COMPUTER COPY HOLDER AND MONITOR RISER STAND

[76] Inventor: Warren E. Burch, Jr., 1400 Deer Ledge Trail, Cedar Park, Tex. 78613

[21] Appl. No.: 09/127,739

[22] Filed: Aug. 3, 1998

[51] Int. Cl.[7] ..... B41J 11/02; A47B 91/00; A47F 7/14

[52] U.S. Cl. ..... 248/442.2; 248/346.07; 248/918

[58] Field of Search ..... 248/441.1, 442.2, 248/346.01, 346.02, 346.03, 346.06, 346.07, 558, 639, 918, 917, 118, 118.1; 211/194

[56] References Cited

U.S. PATENT DOCUMENTS

| | | | |
|---|---|---|---|
| D. 269,749 | 7/1983 | Foster | D6/85 |
| 4,313,112 | 1/1982 | Foster | 248/639 |
| 4,511,111 | 4/1985 | Godfrey et al. | 248/459 |
| 4,635,893 | 1/1987 | Nelson | 248/558 |
| 4,657,214 | 4/1987 | Foster | 248/176.1 |
| 4,893,775 | 1/1990 | Long | 248/442.2 |
| 5,167,394 | 12/1992 | Hegarty | 248/454 |
| 5,470,041 | 11/1995 | Cucinotta | 248/349.1 |
| 5,685,441 | 11/1997 | Calfee | 211/194 |
| 5,735,222 | 4/1998 | Webb | 108/144 |
| 5,826,840 | 10/1998 | Yun | 248/118 |
| 5,855,329 | 1/1999 | Pagano | 248/451 |

*Primary Examiner*—Ramon O. Ramirez
*Assistant Examiner*—David Heisey

[57] ABSTRACT

A combination computer monitor riser, copy holder, and keyboard rest, which provides room for a keyboard and copy holder to be placed in front of computer monitor without obstructing the view of the monitor screen. The copy holder secures open books or individual work sheets in a position between the keyboard and a computer monitor. The copy holder serves as a keyboard holder to create additional workspace when the computer is not in use. The apparatus includes a base plate for holding a keyboard in a manner that can permit a portion of the base plate and keyboard to overhang a conventional work surface; a support plate which is placed against the inclined edge of one or more stacked monitor riser supports; and an inclined rest surface integral to the base plate. The rest surface provides a slight pinch on books and thick documents to hold the pages in an open position. Copy material of varying thickness is supported by sliding base plate and thereby changing the distance between the rest surface and the support plate.

34 Claims, 11 Drawing Sheets

COMPUTER COPY HOLDER AND MONITOR RISER STAND

FIELD OF INVENTION

The present invention relates generally to copy holders and keyboard holders for computer work stations, and more particularly to document holder which is formed in conjunction with at least one monitor riser support.

BACKGROUND

It is desirable to hold a document or a book in position between a keyboard and a monitor so that a person working at a computer work station can more easily transcribe or edit materials on the computer without having to turn to one side to look at a document. The general limitation to providing an inline document holder is a lack of depth of a traditional work surface. There is usually not room between a computer and a keyboard or between a monitor and a keyboard to provide an inline document holder. In the cases where there is room between a monitor and keyboard there is a need to raise the monitor height so that both the monitor and the document to be viewed can be seen without obstruction. For this reason, it is desirable to have a inline document holder and monitor riser combination which will elevate the monitor to approximately the eye level of the user, and to have a keyboard tray which can (extend the keyboard location beyond the edge of a desk or work surface to permit room for the copy holder between the keyboard and the computer monitor.

Many prior art copy holders must be placed to one side of the computer rather than between the computer keyboard and the display. This placement forces the computer operator to constantly look to the left or right to view the copy, often causing neck and back strain, as well as resulting in inefficient work. Other disadvantages of prior art copy holders include their inability to support large or heavy documents, difficulty in accessing computer disk drives, and relatively small surfaces for holding documents.

The prior art includes several attempts to create inline document holders as well as a number of copy holders which are designed to be held at the side of the monitor.

U.S. Pat. No. 4,893,775 to Long discloses an inline copy holder stand equipped with a forwardly inclinable copy holder back which allows access to the computer disk drives. A brace maintains the copy holder back in a generally upright position in which the back is used to hold the copy material. A disadvantage of this design is the requirement to pivot the entire copy holder back forward over the documents in order to access the disk drive of the computer. A preferable method of access for the disk drive is to slide the copy material to the side or merely pick up the material and copy support plate. This simple method of access is possible with the current invention because the copy support plate is completely unattached and merely rests against the base plate, support ridge and front surface of the monitor riser supports. The mechanism of the '775 patent is more complicated than the present invention.

U.S. Pat. No. 5,452,876 to Hatcher, issued on Sep. 26, 1995, describes a copy holder for use inline with a monitor stand which comprises a pull -out copy holder and an incline of about 22 with respect to the table top surface. An object of the present invention is to provide a simpler copy holder which also provides a room for a keyboard and which provides a greater angle of holding the copy for more effective viewing by the user and which is ergonomically correct. It is a further object of the current invention to provide a simple mechanical apparatus providing that copy holding function that does not involving bolting any fixture to a desk or work surface. The current invention permits the use of additional interchangeable copy support plate of varying sizes to accommodate the needs of a user who may have a large work project requiring placement of multiple pages in line of view for reference at the same time.

U.S. Pat. No. 5,104,086 issued to Ramey et al on Apr. 14, 1992, describes a generally planar base plate with an upstanding easel which has a projecting lip. The easel is vertically adjustable and transversely slidable to permit access to the computer disk drive. In addition to its simplicity, an advantage to the present invention involves the ability to effectively hold a book in an open position and allow a one handed turning of pages with the new pages being held in an open position by the pressure of the inclined rest plate.

In addition to the attempt for inline copy holders there have been a number of designs involving the placement of the copy to the side of the computer monitor.

U.S. Pat. No. 5,732,924, issued on Mar. 31, 1998, to Hegarty and Terc describes a counter balanced copy holder which is typically attached to a monitor. That copy holder includes a support arm for orienting the copy holder in space to either the right or left of the computer monitor. The present invention is simpler and requires no support arms.

U.S. Pat. No. 5,651,524 issued on Jul. 29, 1997, to Calfee for adjustable document holder for a computer work station describes a document holder which may be positioned along three mutually perpendicular axes and which may be rotated about one of the axis to place the easel in a selective working position.

A problem with prior art computer copy holders is that the copy holders are designed for only a few specific types of computers. Thus, prior art work stations were not always designed to permit disk entry access from different locations, nor to retain various types and sizes of disk drive units, monitors and keyboard placements.

It is an object of the current invention to provide a inexpensive document holder to hold documents in a convenient inline manner between the user, the computer keyboard and the computer monitor.

It is a further object of the current invention to provide a inexpensive document holder to hold heavy documents such as books in a convenient inline manner between the user, the computer keyboard and the computer monitor.

It is a further object of the current invention to provide a document holder which will hold single sheets, small tablets or larger books in place without the need for clips, springs or other devices to hold open a document.

It is a further object of the current invention to provide a document holder that is adjustable in a simple manner from a single document to a relatively thick book.

It is a further object of the current invention to reduce the number of mechanisms, avoid the use of an arm device and provide a detached copy support plate for ease of use.

It is further object of the current invention to provide a document holder for a book which will permit the pages of the book to be turned and held in an open position without the requirement of a spring, clip or other device.

It is further object of the current invention to provide a combination document holder, keyboard tray and monitor riser that will serve to raise the monitor to an eye level position for the user.

It is further object of the current invention to provide a simple combination device with a keyboard tray in a manner that increases the effective width of a work surface to permit room for an inline document holder on virtually any size desk or table.

It is further object of the current invention to provide a simple combination device with a keyboard tray in a manner that increases the effective work surface by providing a storage space for a keyboard when the computer is not in use.

It is further object of the current invention to provide a simple combination device with a keyboard tray that is not attached by bolts, screws or other fasteners to anything, thereby allowing easy removal for storage when not in use.

It is a further object of the current invention to provide a document holder that can hold multiple pages or an open book and a page simultaneously by increasing the number or size of detached and removable copy easels.

It is further object of the current invention to provide a simple mechanical device that will work equally well with tower style or desktop style computers so as to be capable of utilization with substantially all computer hardware.

It is further object of the current invention to provide a simple relatively inexpensive document holding capability without requirement for moving parts or a large number of parts.

A further object of the current invention is to provide a computer work station which permits access to the disk drive while maintaining the copy holder stand in an upright position.

Yet another object of the present invention is to provide a computer workstation which is economical to manufacture, refined in appearance, and simple to utilize but nevertheless maximizes function. These and other objects will be apparent to those skilled in the art.

An object of the present invention is to provide a inline document holder which is simply and easily adjustable for varying thickness of documents without the necessity of having an additional holding mechanism.

The terms copy holder, easel, and tray are generic descriptions of support means, and it is obvious to those skilled in the art that many types of supports may be employed in the invention. Terms such as front, rear, top, bottom, left, and right are used to communicate the nature of the invention and not to restrict its application.

SUMMARY OF INVENTION

The preferred embodiment computer work station of the present invention includes a generally planar base plate with an upstanding easel which rests near the forward end of the base plate. The easel has a projecting lip which will support documents or other copy in an upright position for viewing by the user of the work station. In the preferred embodiment, the easel rests against a support member which is slidably connected to the base plate thereby permitting transverse lateral slidable movement and easy removal of the easel with respect to the base plate. The support member slidably connected to the base plate can be moved against the resting easel to securely hold copy material of varying thickness by moving the base plate in the direction of the computer monitor. The base plate also is a keyboard tray, hereinafter also called a keyboard plate which provides additional room for placement of a computer keyboard even beyond the edge of a work surface.

BRIEF DESCRIPTION OF THE DRAWINGS

These and other objects and advantages of the present intention are set forth below and further made clear by reference to the drawings, wherein.

DESCRIPTION OF THE PREFERRED EMBODIMENT

Figure 1:
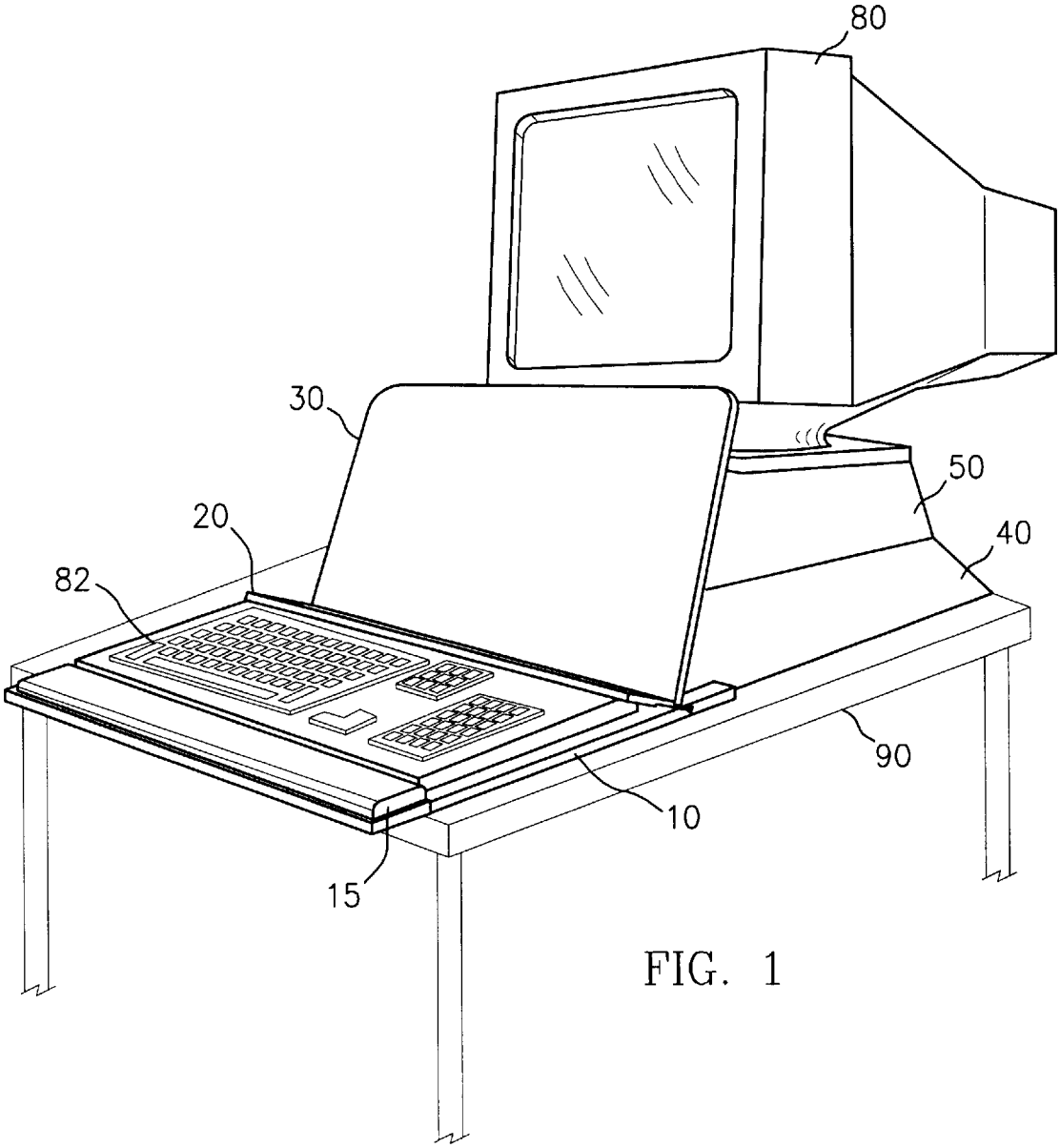
FIG. 1 is a perspective view of the preferred embodiment for a tower type computer, showing two monitor risers, a keyboard plate, a copy support plate, and a wrist support.

Referring now to FIG. 1, which is a perspective view of the preferred embodiment, a generally rectangular and planar keyboard plate 10 rests upon a work service such as a desk or computer table 90.

In the preferred embodiment, the keyboard plate may extend beyond the edge of a work surface by two to four inches in order to create room for the document holder to be placed between the keyboard and the monitor. This extension is an important feature because many traditional work surfaces lack sufficient depth to permit a computer console with all of its cable attachments, a computer keyboard and still allow any room for a inline copy holder. By extending this work surface by an additional 2 to 4 inches, the user has the ability to place the copy materials directly in line between the keyboard and the monitor. Placing copy materials in line of sight directly below a monitor screen, without obstruction of such screen, results in ease of viewing of copy material and greatly enhances worker comfort.

The keyboard plate has an integral inclined rest surface 20 which makes an angle of approximately 50 to 70 degrees with respect to the keyboard plate and is slanted upwardly in the direction toward the front of the keyboard tray and enables a user to see the bottom of the copy material without obstruction. The inclined rest service is located approximately 5 inches from the back or rear edge of the keyboard tray and approximately 9 to 12 inches from the front surface of the keyboard tray such that a standard size computer keyboard 82 will fit between the inclined rest surface and the wrist support 15 on the front edge of the keyboard tray. In the case of a tower computer with separate monitor 80, a first riser support, support A, 40 will rest upon the computer work surface, and a second riser support, support B, 50 will rest upon the first riser support. The monitor is placed upon the second riser support.

Figure 2:
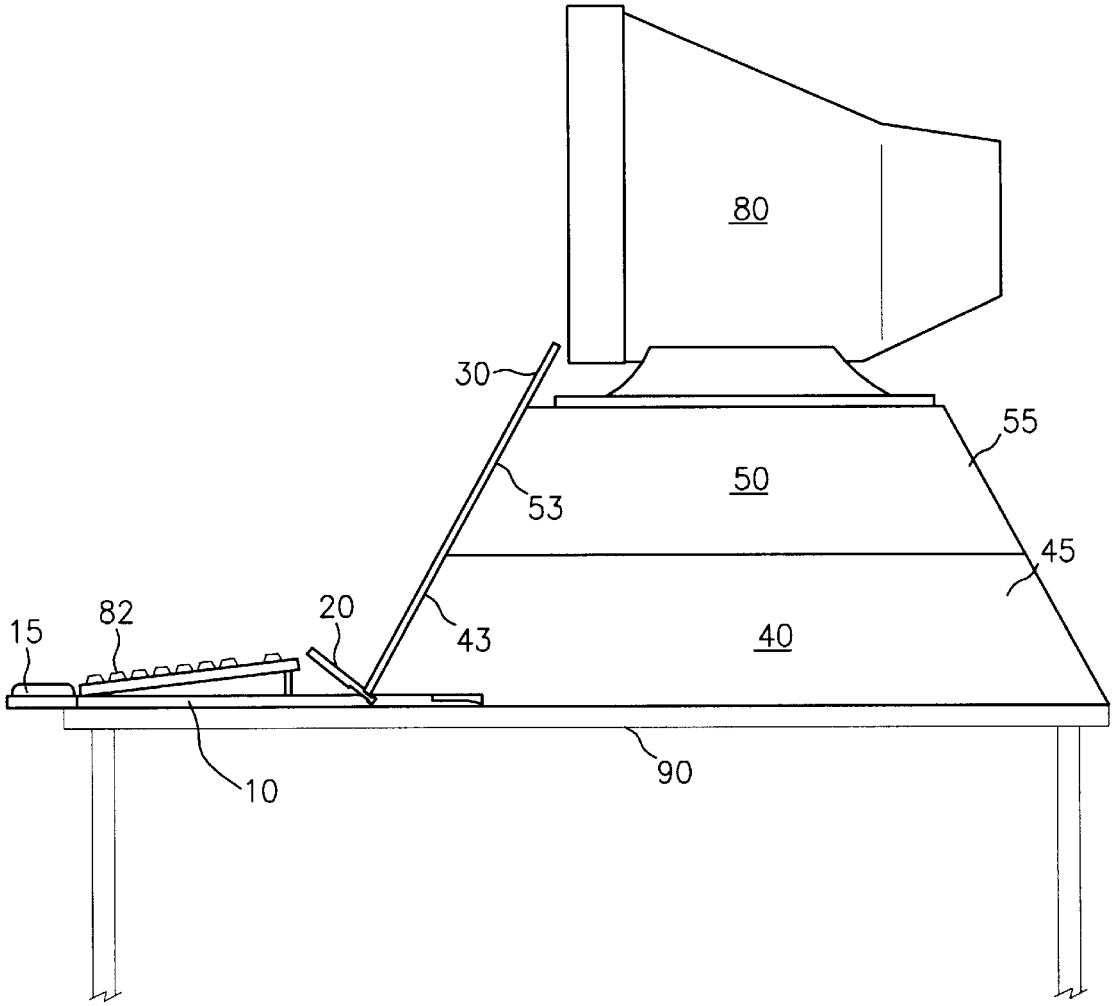
FIG. 2 is a side view of the preferred embodiment for a tower type computer.

Referring now to FIG. 2 which is a side view of the preferred embodiment, the rear edge keyboard plate 10 is slid horizontally along the work surface under the front edge of the first riser support 40. The front edge of the first riser support is recessed by approximately 4 inches along the front surface at a depth of approximately ¼ inch. This creates a gap or space having a height of approximately ¼ inch from the top of the work surface and having a depth of approximately 4 inches. The keyboard plate 10 is approximately ¼ inch thick, with the rear approximately 3 inches being tapered to a thickness of about ⅛ inch and having a beveled rear edge so that the very rear portion of the tray can be slid between the bottom surface of the monitor riser 40 and the work surface 90 in order to create a cantilever effect when the front edge of the keyboard tray overhangs a work surface, thereby stabilizing the keyboard tray.

Figure 5:
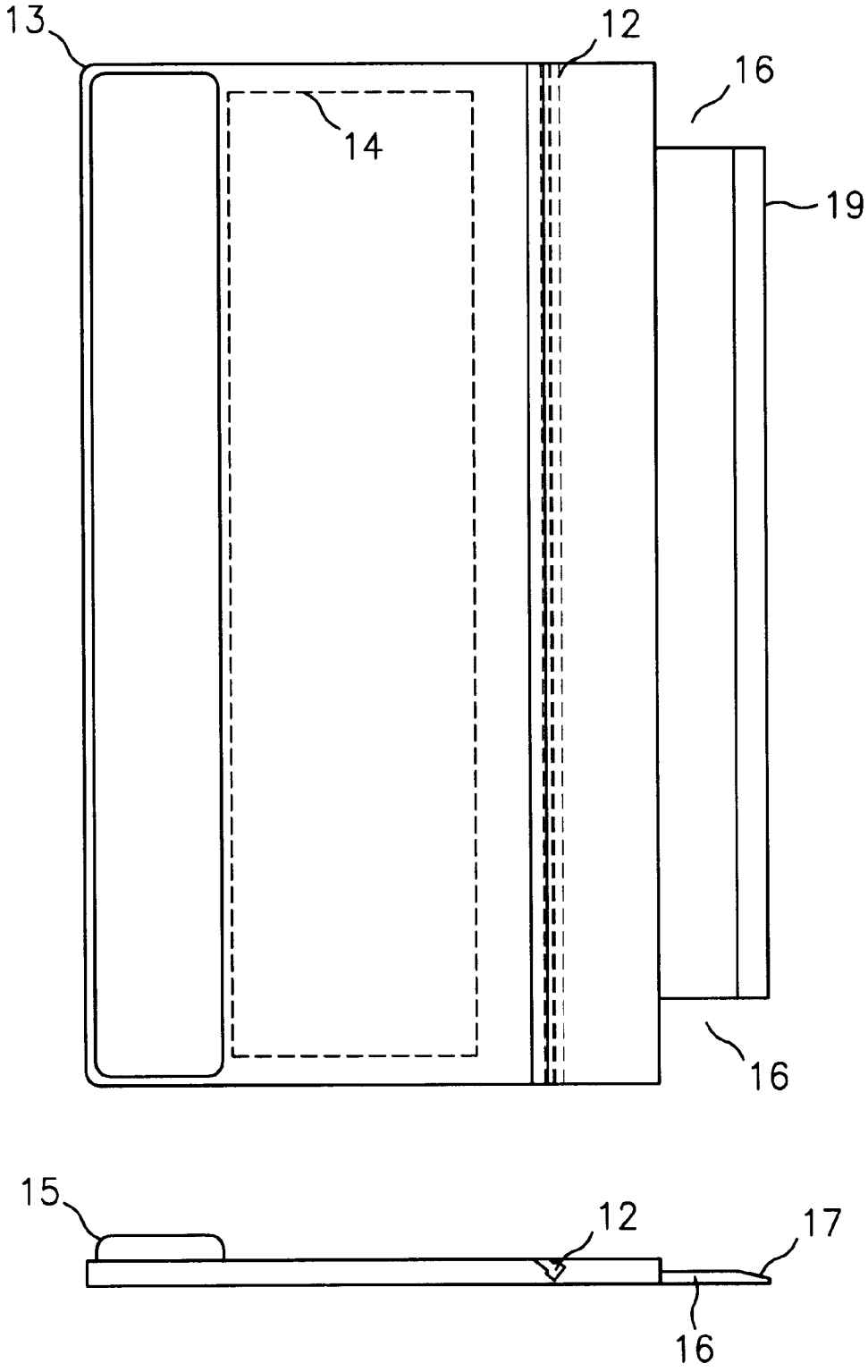
FIG. 5 is a detailed top and cross sectional view of the keyboard plate with a wrist support.

Referring now to FIG. 5, the rear corners of the keyboard plate are removed by making cut-out portions further identified as notch 16 on both rear corners, 16 having dimensions of approximately 2 inches from the rear edge on each side and inwardly from each side approximately 4 inches so that the keyboard plate can be conveniently slid underneath a desktop computer in an alternative embodiment, and easily removed without obstruction from the computer leg supports and without being required to move or lift the computer. When used with a tower type computer, the keyboard plate can be inserted horizontally along the work surface underneath the first monitor riser support in the recess to a point where the inclined support plate rest surface 20 integral to the keyboard presses against the bottom edge of an open book or other copy material. An open book positioned on the top surface of the copy support plate is thereby squeezed between the copy support plate and inclined rest surface 20. Adjustment is also thereby made to secure thick or thin copy material.

Referring now to FIG. 2, the copy material is then secured between the inclined support plate 20 and the copy support plate 30 which rests against the front inclined surface of the monitor riser supports 43 and 53. By placing the rear portion of the keyboard plate in the recess, a cantilever effect is also created which effectively stabilizes the keyboard tray 10 when the front edge of the keyboard tray overhangs the front edge of a work surface 90. The weight of support A and support B and of the computer monitor provide a friction on the keyboard plate to resist movement of the keyboard plate. This friction combined with the approximate equal height of the recessed area and thickness of the keyboard plate enables movement away from or toward the user while maintaining stability of the keyboard plate. Since inclined rest surface 20 is integral to keyboard plate 10, by moving the keyboard plate toward the user, additional room is provided between copy support plate and inclined rest surface for thicker copy material. The rear surface of copy support plate 30 rests against the monitor riser supports which do not move because of the weight of the monitor 80, FIG. 2. The combination copy holder, monitor riser and keyboard tray can thereby adjustably secure copy materials of varying thickness, and can be used even when the work surface lacks sufficient depth. The components may be easily removed when not in use without lifting the monitor, monitor riser, or computer.

Riser support A 40 has a preferred height of four and one-half inches, a preferred depth of fifteen inches and a preferred width of twelve inches. Riser support B 50 has a preferred height of approximately two inches, a preferred depth width of approximately thirteen inches and a preferred width of twelve inches.

Although any material which will provide the height and desired angles will provide a functional riser support, the preferred material construction for the riser supports is 1/16 inch thick ABS sheet with a hair cell finish, preferably light gray, rigidly encapsulating a medium density foam core of polypropylene, preferably 2 pound polystyrene, or a recycled polymeric material. The preferred foam core provides substantial rigidity and strength to hold a weight in excess of 100 lbs. with less weight than other solid materials and is economic in material cost and manufacturing process. The preferred light gray hair cell finish of ABS aesthetically conforms to an office environment and blends with the aesthetics of many computers and monitors. The preferred method of manufacture is to vacuum form a 1/16 shell (consisting of ABS which forms the rigid coating. A molded or cut foam core is inserted and attached or glued inside the shell. A 1/16 inch ABS plate is then glued to the bottom of the riser.

The combined height of the riser support raises the monitor to a height of about 4½ to 6½ inches over the work surface which provides an ergonomically correct viewing height for the monitor and which permits enough height for an 11" document to be inclined in front of the monitor without obstructing the view of the typical monitor screen.

The front surface 43 of riser support A, and the front surface 53 of riser support B have the same angle with respect to the work surface of approximately 45 to 60 degrees, with a preferred angle of 50 degrees. The rear surface 45 of riser support A and the rear surface 55 of riser support B have an angle of approximately 50 to 70 degrees, with a preferred angle of 65 degrees, which provides an alternate steeper angle to be used in the case where a single desk top computer chassis is placed on the work surface and riser support A is placed between the desktop computer console and the computer monitor. The rear angle of riser support B is used in other embodiments.

Referring now to FIG. 5, which is a detailed top and side view of the keyboard plate, the tray has rounded comers 13 and a groove 12 to support the inclined rest surface. The preferred dimensions of the plate are a thickness of about ¼ inch; a length of about 20 inches, which is approximately 2 inches longer than a standard keyboard, and a rear edge 19 length of about 12 inches, which is approximately the width of riser support A; and a width of about 16 inches including the wrist support. The keyboard plate holds a wrist support 15. Alternately, other types of purchased wrist supports may be placed upon the keyboard plate.

Figure 3A:
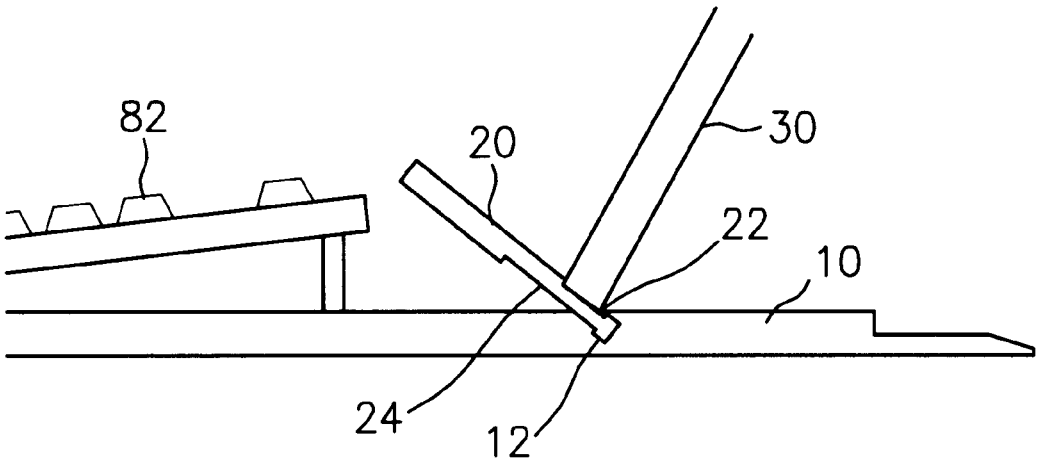
FIG. 3A and 3B are enlarged side views of a tongue and groove assembly of the inclined rest surface, the copy support plate, and the keyboard tray.

Referring now to FIG. 3, a groove 12 is formed in the upper face of the keyboard plate 10, and extends from the left to right edges of the tray, parallel to the front edge of the keyboard plate and is preferably located 4 to 6 inches from the rear edge of the keyboard plate. The groove is preferably approximately 2/16 to 3/16 inches wide and is designed to slidably engage the lower edge of the inclined rest surface 20.

The inclined rest surface 20 is preferably about a ¼ inch thick plate with a width of about 1¾ inches, which is adequate to support most books or thick documents. The rest surface is placed in the groove 12 in the keyboard plate. The rest surface plate preferably includes a groove on the top surface 22 and a groove on the bottom surface 24 in order to facilitate the support of the inclined plane. When the inclined rest surface is slidably inserted with its top surface facing the monitor, a groove having a width of approximately ¼ inch, a depth of approximately 1/16 inch and extending the length of the inclined rest, is formed above and adjacent to the upper surface of the keyboard plate so that a copy support plate 30 will fit and hook at the bottom of the inclined rest surface. The advantage of such a groove is that the copy support plate will hook and be secured when the copy support plate is extended to either side of the keyboard plate beyond the side edge of the keyboard plate and thereby enables further stable extension of the copy support plate to the side as detailed in alternate embodiments.

The copy support plate 30, has preferred dimensions of 18 to 22 inches in width and 9 to 11 inches in height. In the preferred embodiment, keyboard function templates and instructions for operating word processing, spreadsheet, Internet browsers, and other computer software are printed on both sides of the support plate so that the user has a convenient help tool available. When copy material is not used, the operator can view the help instructions. The operator can also remove the copy material in cases where a quick reference to the instructions is required.

Figure 3B:
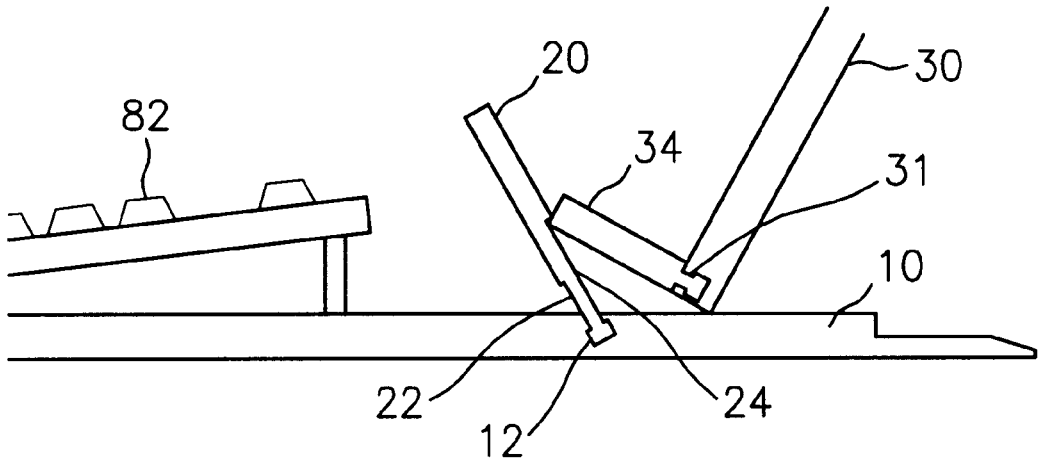
Figure 4:
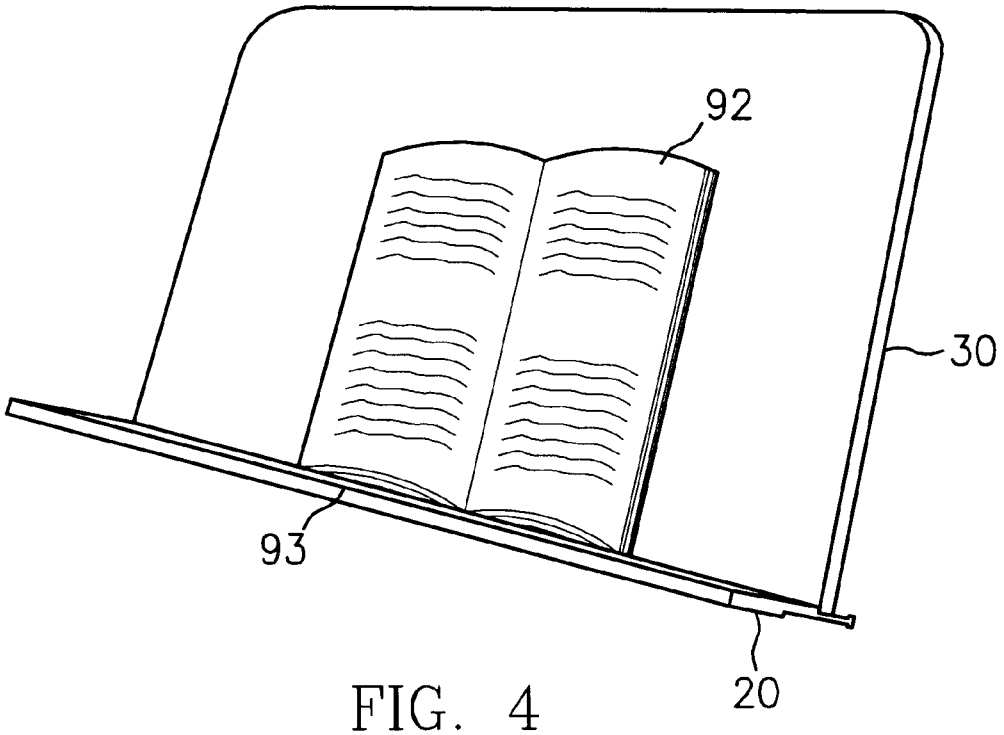
FIG. 4 is a perspective view of a book held open by the inclined rest surface.

When the inclined rest surface is slidably inserted with its bottom side facing the monitor, a groove having a width of approximately 1 inch, a depth of approximately 1/16 inch and extending the length of the inclined rest is formed above and adjacent to the upper surface of the keyboard plate so that a copy support plate that has an "L" shaped lip integral lip 34, FIG. 3B, having a width of approximately 1½ inches at the bottom will hook and secure the keyboard tray when the copy support plate is extended to either side of the keyboard plate beyond the side edge of the keyboard plate. The copy support plate may include this integral lip on two adjacent edges of the copy support plate such that the copy support plate may be extended beyond the side edge of the keyboard tray in either a landscape or a portrait orientation. The inclined rest surface can be removed and stored by simply sliding the plate in either direction until it disengages from the groove in the keyboard plate. The keyboard plate, inclined rest surface and copy support plate are preferably composed of light gray ¼ inch thick expanded foam PVC, or other polymer material which combines strength and rigidity with ease of manufacture.

The copy holder is produced by placing the copy support plate against the incline surfaces and of the riser supports. The bottom edge of the copy support plate rests against the keyboard plate near the groove. Alternately, the bottom edge of the copy support plate may rest against the inclined rest surface. In the case of the single document, the copy support plate bottom edge will rest adjacent to the inclined rest surface. In the case of thicker books the keyboard plate will be pulled away from the riser supports such that a space is created between the bottom edge of the copy support plate and the incline rest surface. The copy support plate may be removed and stored by simply lifting the plate from its rest position. The ease of installation and removal of the copy support plate and inclined rest surface provides an advantage over prior art designs.

Figure 9:
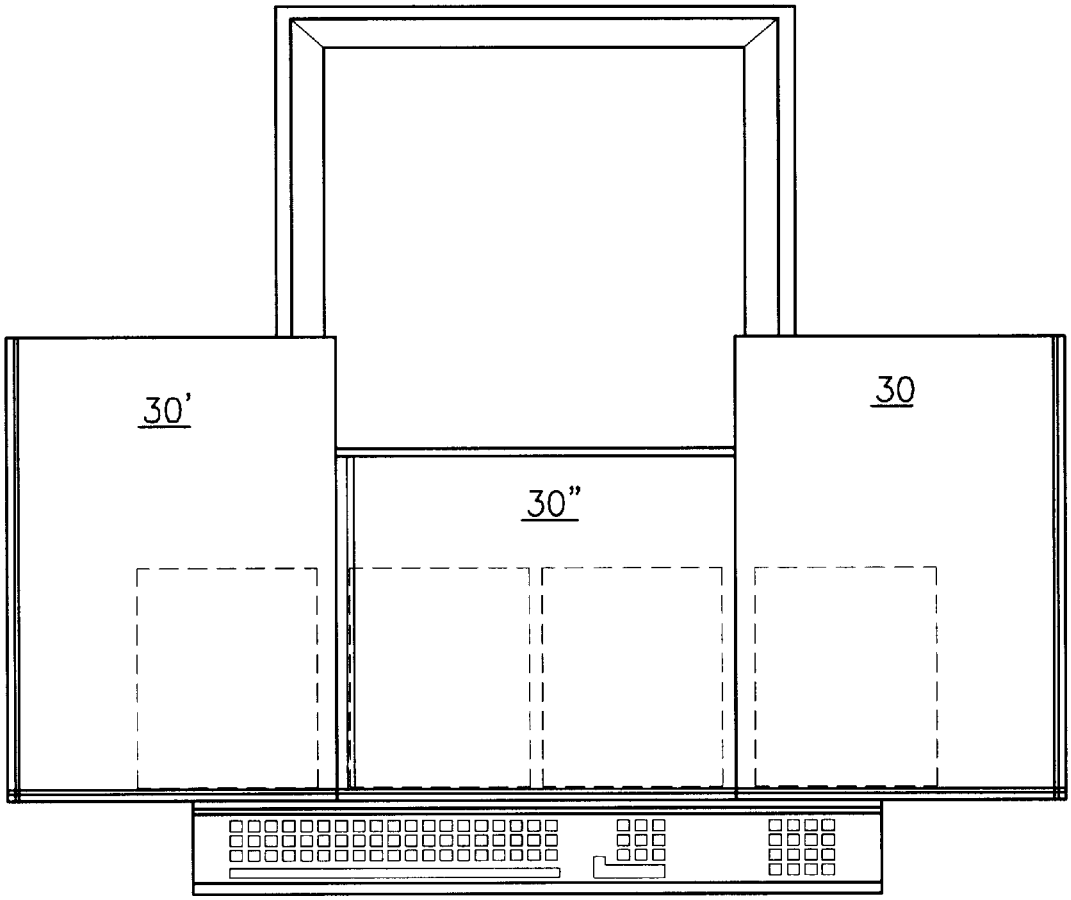
FIG. 9 is a front view of an extended copy support plate embodiment with three support plates.

Referring now to FIG. 9 which is a perspective view of an opened book 92 resting against the copy support plate 30, the pages of the book 93 are held open due to a slight pinching of the book between the copy support plate 30 and the incline rest surface 20. The pages of the book may still be turned and will be held in an open position by the pressure of the inclined rest surface which makes an angle less than 90 degrees with respect to the copy support plate. The preferred range of angles between the inclined rest surface and the copy support plate is 50 to 70 degrees, with a preferred angle of 65 degrees. The inclined rest surface is slanted in the direction toward the front of the keyboard plate so that the bottom of a page can be seen by a user without obstruction of view by the inclined rest surface.

To use the invention as a copy holder, the computer operator assembles the device by sliding the inclined rest surface into the groove on the keyboard plate, and by placing the copy support plate against the riser supports A and B. The document or documents are then placed against the copy support plate. The riser supports would generally be positioned permanently underneath a monitor for ergonomic correct height adjustment of the monitor and thereby further provide a permanent and convenient inclined rest surface for the back of a copy support plate.

Upon completion of the transcribing or other computer activity, the operator may choose to leave the copy support plate in the upright position or the operator may remove the copy support plate and the inclined rest surface.

Although the invention has been described with respect to specific embodiments, it will be understood by those skilled in the art that variations and modifications can be made in these specific embodiments without departing from the scope or spirit of the invention.

ALTERNATE EMBODIMENT

Desktop Computer

Figure 6:
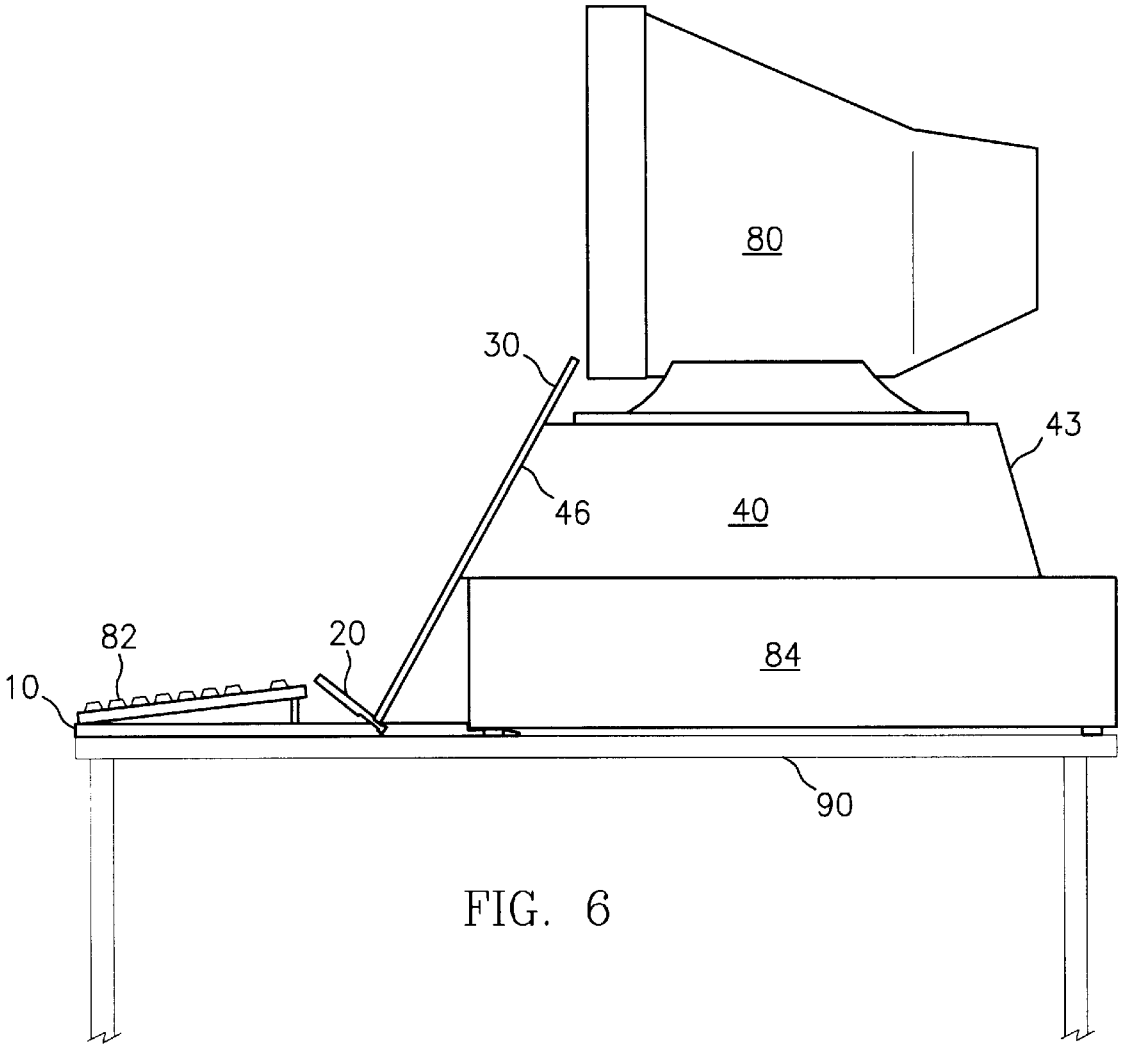
FIG. 6 is a side view of desktop computer embodiment showing the computer, one monitor riser, a keyboard tray, and a copy support plate.

Referring now to FIG. 6 which is a side view of a desktop computer embodiment, the desktop computer 84 sits on the work surface 90. A single riser support A 40 sits on top of the computer. The monitor 80 rests on the riser support. The keyboard plate 10 slides partially underneath the computer chassis.

In this illustration, the riser support has been rotated 180 from the previous preferred tower computer embodiment so that the steeper angle 46 is presented to the front of the monitor. Either angle of the riser support may be used depending upon user preference and the height of the monitor chassis. A relatively short monitor chassis may require the shallower angle 43 in order to avoid obstruction of part of the monitor, while a relatively tall chassis may provide enough height that the user can select the steeper angle.

The copy support plate 30 rests against the steeper incline surface 46 and against the keyboard plate 10 adjacent to the inclined rest surface 20.

For illustration, this embodiment is shown without the keyboard plate extension beyond the edge of the work surface. The embodiment is also illustrated without the wrist support. The wrist support and the extension could be supported in the desktop computer embodiment.

For the typical desktop computer, which has a front disk drive, the user may install a disk before placing the copy support plate. In order to access the disk drive in use, the user may remove the copy support plate, slide the plate to one side, or tilt the plate forward.

ALTERNATE EMBODIMENT

Keyboard Holder

The various embodiments of the invention including the preferred embodiment and the desktop embodiment can function as a keyboard holder at times when the keyboard is not in use. In this embodiment, the computer operator places the keyboard in the document holder such that the keyboard is supported by the inclined rest surface and the copy support plate. By temporarily storing the keyboard in this convenient location, the computer operator can create additional work space on the keyboard plate in front of the computer monitor. The work space can include the overhang area where the keyboard plate overhangs the desk or table surface.

ALTERNATE EMBODIMENT

Multiple-Angled Riser Supports

Figure 7:
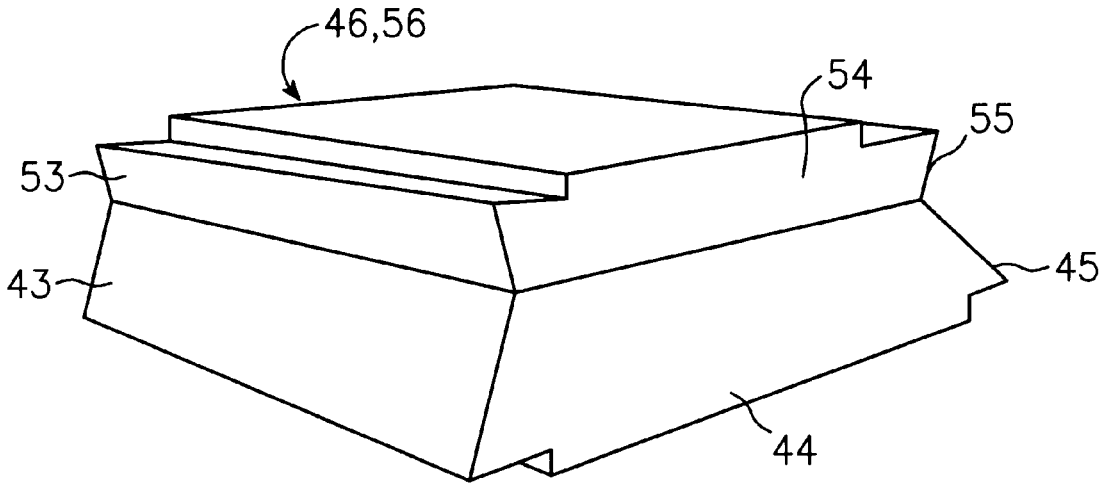
FIG. 7 is a perspective view of a multi-angled riser embodiment.

Referring now to FIG. 7 an alternate monitor riser is shown, wherein each of the sides of the monitor supports have different slopes from those of the preferred embodiment. Slopes 43 and 53 are the same, but all other slopes can be different. The figure shows riser support B inverted over riser support A. By placing an inverted riser support on top of a lower riser support, the top surface area is increased, thereby creating a greater area and flexibility for placement of a monitor. Riser support A shows a front angle 43, a side angle 44, a rear angle 45, and a far side angle 46. Riser support B shows a front angle 53 a side angle 54, a rear angle 55, and a far side angle 56. The principal advantage to this type of a riser embodiment is additional flexibility in establishing a desired slope of the copy holder.

A single riser support will provide sufficient support for the copy support plate, so any of these angles can be selected by placing the desired angle as the top riser support. If the desired angle of the front surface of the riser support is different from the riser support on the bottom support, then the top support will be slid forward at a slight offset with respect to the bottom support so that the copy support plate will be held at the angle of the top support.

ALTERNATE EMBODIMENT

Molded Inclined Rest Surface

An alternative embodiment is to manufacture the keyboard tray with the inclined rest surface as a single unit. The advantages of this design include less parts, additional rigidity, strength, and ease of manufacture by means of a single mold. The disadvantage to the approach is that more space is needed for shipping, storage and packaging since the entire invention can no longer lie flat. In this embodiment, the inclined rest plate cannot be removed without removing the keyboard tray.

ALTERNATE EMBODIMENT

Wrist Support

Figure 10A:
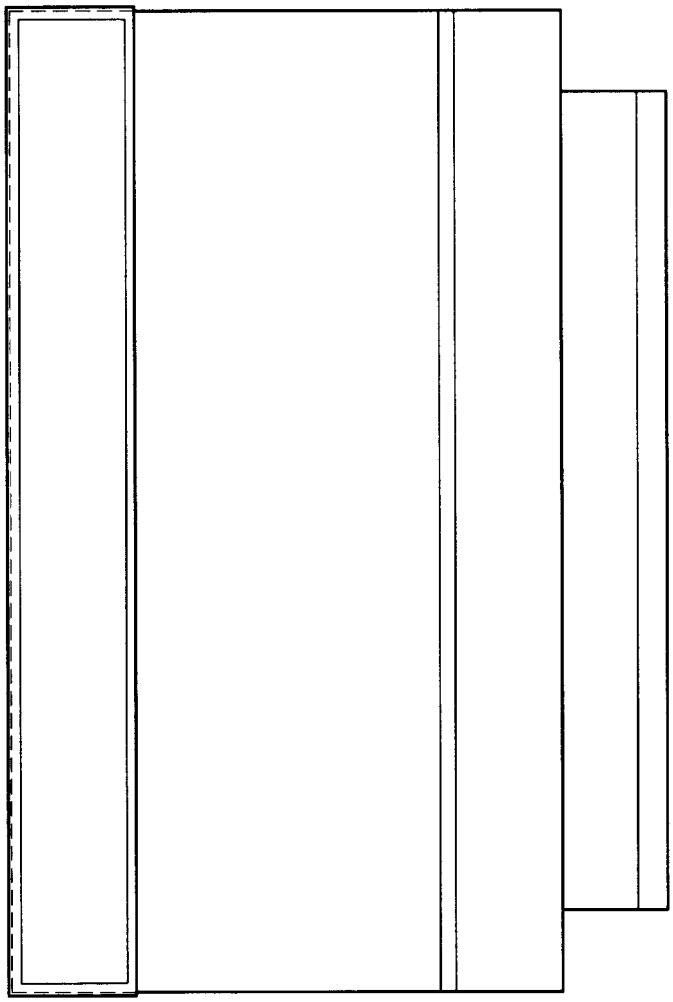
FIG. 10A–10C are top and cross section views of a tray with wrist support.
Figure 10B:
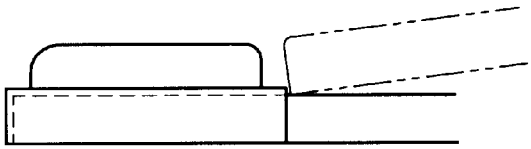
Figure 10C:
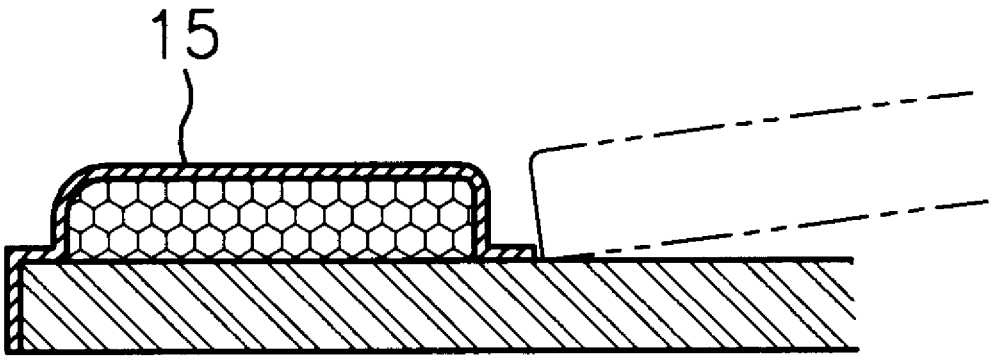

Referring now to FIG. 10A, the keyboard tray may include a space for a conventional wrist support. Alternately, a molded wrist support may be provided with the keyboard tray as shown in FIG. 10C. The preferred wrist support consists generally of an approximately ⅛ inch thick molded shell of ABS; having a width of approximately 20 inches, a depth of approximately 2½ inches, a height of approximately ⅜ inch in the front and a height of approximately ¾ inch in the rear. The lower edge rests on the top surface of the keyboard plate and extends to the left and right edges of the keyboard plate and then extends along the side edges of the keyboard plate a distance equal to the thickness of the keyboard plate. The wrist rest is securely attached to the keyboard plate and fitted on top of the front portion of the keyboard plate when in use.

ALTERNATE EMBODIMENT

Extended Copy Holder

Figure 8:
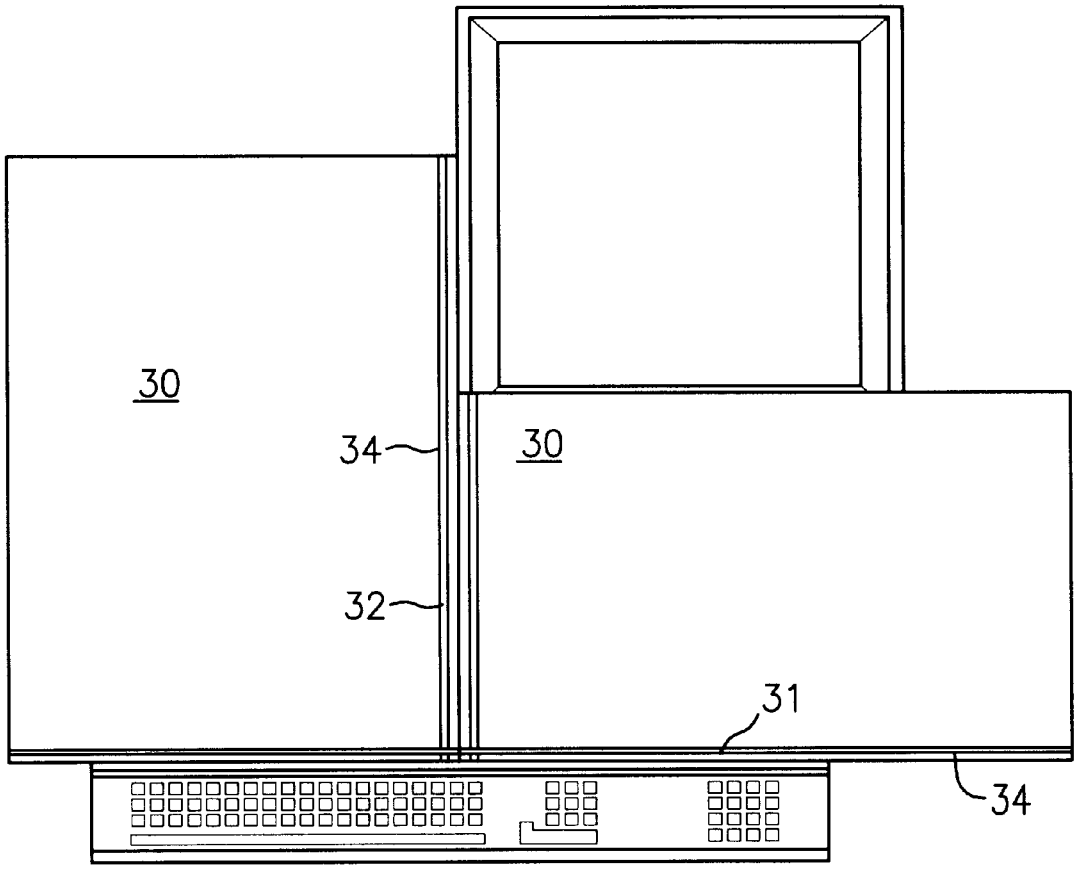
FIG. 8 is a front view of an extended copy support plate embodiment with two support plates.

Referring now to FIG. 8, it is possible to rotate the first copy support plate 30' by 90 degrees, thereby creating a taller and narrower copy support surface. In this case, when using copy material having a length greater than 11 inches, it may be desirable to shift the copy holder to the side of the monitor so as to avoid blocking portions of the monitor.

This shift and rotation of the copy holder is enabled by providing a groove shown as 32 along the short edge of the copy holder, and providing the integral lip 34 which can be slid into the groove in order create an easel to prevent the copy material from sliding off of the copy support plate.

FIG. 8 also shows a second copy support plate 30 which is not rotated. This copy support plate demonstrates the use of a second groove 33 along the long edge of the copy holder, and providing a separate strip 34 which can be slid into the groove in order to create an easel to prevent the copy material from sliding off of the copy support plate.

In another embodiment of this extendible support plate, it is desirable to put grooves in both the narrower and the longer edges of the copy support plate to permit this versatility of constructing easels for the extended surfaces. For instance if the copy support plate has a width of twenty inches and height of ten inches, then it is desirable to provide grooves in both the twenty and the ten inch surface or edges approximately ½ inch from the edge of the holder and to provide two ten inch strips so that a strip can be provided along either the narrower or the wider edge of the copy support plate. The easel strips will have a width of approximately ½ to 1 inch in order to support relatively thin materials.

In another embodiment as shown in FIG. 9, a third, smaller, copy support plate 30" is provided in the center, between two other copy support plates 30 and 30'. This copy support plate 30" will typically have dimensions of approximately 8 to 10 inches in length and 8 to 10 inches in height. This embodiment will permit a maximum display of documents.

ALTERNATE EMBODIMENT

Three Risers

In some cases, it is desirable to provide a maximum flexibility in configuration by supplying three monitor risers so that the user can configure the copy holder in the most convenient. In this embodiment, three risers of approximately 2 inch thickness and 1½ inch thickness are provided. Each of these risers have the same angle present on the face so that three risers can be stacked creating a uniform inclination along the surface to be presented toward the user.

What is claimed is:

1. A document holder and monitor riser for a computer workstation comprising a substantially horizontal keyboard plate support means having a top surface, a bottom surface, a front edge, a rear edge, a right side edge, and a left side edge;

an upstanding tab integral to the top surface of the keyboard plate;

at least one riser support means having a front inclined planar surface, a top surface, and a bottom surface, such that a computer monitor may be placed upon a stack of one or more of the riser support means; and a copy support plate having a top surface, a bottom surface, and a bottom edge, such that a portion of the bottom surface of the copy support plate rests against the front inclined planar surface of the riser support, and the bottom edge of the copy support plate rests against the top surface of the keyboard plate and the tab, and such that the tab serves as a lower support for a document placed upon the top surface of the copy support plate whereby the keyboard plate may be pulled away from said riser support means thereby creating a space between said tab and said copy support plate when needed for thicker documents.

2. A document holder and monitor riser as described in claim 1 wherein the upstanding tab is inclined toward the front edge of the keyboard plate at an angle of approximately 65 degrees with respect to the keyboard plate.

3. A document holder and monitor riser as described in claim 1 wherein the upstanding tab is created by sliding a removable tab into a groove located on the top surface of the keyboard plate.

4. A document holder and monitor riser as described in claim 3 wherein the groove is substantially parallel to the front edge of the keyboard plate and is located approximately 6 inches from the rear edge of the keyboard plate.

5. A document holder and monitor riser as described in claim 1 wherein the front lower portion of the riser support rests partially upon the rear portion of the keyboard plate, such that the weight of the riser support and the monitor tends to create friction to prevent movement of the keyboard plate.

6. A document holder and monitor riser as described in claim 5 wherein the rear edge of the keyboard plate is notched on its corners, and the rear edge of the keyboard plate is gradually tapered, such that it can be slid underneath a riser support or desktop computer; and a portion of the bottom front surface of the riser support is cut out to a depth of approximately 4 inches for a thickness approximately equivalent to the greatest thickness of the keyboard plate, so that the keyboard plate may be slid into the cutout portion of the riser support in order to help secure the keyboard plate against movement.

7. A document holder and monitor riser as described in claim 1 wherein the copy support plate contains a first groove which is substantially parallel to a first edge;

the copy support plate is placed so that the groove is located along the bottom edge of the copy support plate and a portion of the copy support plate overhangs a side edge of the keyboard plate; and at least one tab is inserted into the copy support plate groove such that an integral lip is created on the copy support plate along the bottom of the copy support plate thereby creating an extended surface for supporting a document.

8. A document holder and monitor riser as described in claim 7 wherein the copy support plate contains a second groove which is substantially parallel to a second edge, and substantially perpendicular to the first edge;

the copy support plate is placed so that the second groove is located along the bottom edge of the copy support and a portion of the copy support plate overhangs a side edge of the keyboard plate; and at least one tab is inserted into the copy support plate second groove such that an integral lip is created on the copy support plate along the bottom of the copy support plate thereby creating an extended surface for supporting a document.

9. A document holder and monitor riser as described in claim 7 wherein the copy support plate has an integral lip on two adjacent edges such that the copy support plate may be extended beyond the side edge of the keyboard plate in either a landscape or a portrait orientation.

10. A document holder and monitor riser as described in claim 1 wherein the riser support has at least two inclined surfaces.

11. A document holder and monitor riser as described in claim 1 wherein there is a second riser support means having at least one inclined surface with approximately the same angle as the front inclined surface of the of the first riser support means, a top surface, and a bottom surface; and the bottom surface of the second riser support means has approximately the same length and width as the top of the first riser support means.

12. A document holder and monitor riser as described in claim 11 wherein there is a third riser support means having at least one inclined surface, a top surface, and a bottom surface; and the length and width of the bottom surface of the third riser support means is approximately the same as the length and width of the top surface of the second riser support means.

13. A document holder and monitor riser described in claim 1 wherein at least one surface of the copy support plate is printed with instructions for operating a computer software program.

14. A document holder and monitor riser described in claim 1 wherein a wrist support is provided integral to the keyboard plate.

15. A method of creating an in-line copy holder to hold a document in place for viewing by a computer operator of a tower-style computer workstation located on a work surface, the method comprising the steps of:

placing a first riser support means on the work surface such that the first riser support means has a first inclined planar surface presented toward the computer operator;

placing a computer monitor on top of the first riser support means;

sliding a keyboard plate on top of the work surface such that the rear of the keyboard plate fits under the front edge of the first riser support means, and the keyboard plate has an integral inclined rest surface substantially parallel to the front edge of the keyboard plate;

placing a copy support plate such that the back of the copy support plate resides against the first inclined surface of the first riser support means and the bottom edge of the copy support plate resides against the keyboard plate to the rear of the inclined rest surface;

placing a keyboard on the keyboard plate between the inclined rest surface and the front edge of the keyboard plate;

placing a document against the top surface of the copy support plate; and adjusting the position of the keyboard plate to permit a document to be held in place between the copy support plate and the inclined rest surface such that the document is held in a position in front of the monitor and behind the keyboard, so that the document can be viewed by the computer operator.

16. The method of claim 15 comprising the additional steps of:

rotating the first riser support means so that a second inclined surface is presented toward the computer operator, the second inclined surface having a different angle than the first inclined surface.

17. The method of claim 15 comprising the additional steps of:

placing a second riser support means on top of the first riser support means; and sliding the keyboard plate on top of the work surface such that the rear of the keyboard plate fits under the front edge of the first riser support means.

18. The method of claim 15 comprising the additional step of:

placing the keyboard plate on the work surface so that the front of the keyboard plate overhangs the work surface by approximately 1 to 4 inches, thereby creating an additional effective depth of the work surface and permitting room for the document to be held between the keyboard and the monitor.

19. The method of claim 15 comprising the additional step of creating the integral inclined rest surface of the keyboard plate by sliding a removable tab into a groove located on the keyboard plate.

20. The method of claim 15 comprising the additional steps of providing a first groove in the copy support plate which is substantially parallel to a first edge;

placing the copy support plate such that the groove is located along the bottom edge of the copy support plate and a portion of the copy support plate overhangs a side edge of the keyboard plate; and inserting at least one tab into the groove such that an easel lip is created on the copy support plate along the bottom of the copy support plate to enable holding a document in place.

21. The method of claim 20 comprising the additional step of placing a second copy support plate such that the back of the second copy support plate resides at least partially against the front inclined surface of the first riser support means and the bottom edge of the copy support plate resides at least partially against the keyboard plate to the rear of the inclined rest surface, and such that the second copy support plate does not overlap the first copy support plate.

22. The method of claim 21 comprising the additional steps of placing a third copy support plate between the second copy support plate and the first copy support plate.

23. The method of claim 15 comprising the additional steps of providing a first groove in the copy support plate which is substantially parallel to a first edge;

placing the copy support plate such that the groove is located along the bottom edge of the copy support plate and a portion of the copy support plate overhangs a side edge of the keyboard plate; and inserting at least one tab into the groove such that an easel lip is created on the copy support plate along the bottom of the copy support plate to enable holding a document in place.

24. A method of creating an in-line copy holder to hold a document in place for viewing by a computer operator of a desktop-style computer located on a work surface, the method comprising the steps of:

placing the computer on the work surface;

placing a riser support means on top of the computer such that the riser support has a first inclined planar surface presented toward the computer operator, such that the first surface overhangs the front of the computer by approximately 1 to 2 inches;

placing a computer monitor on top of the riser support means;

sliding a keyboard plate on top of the work surface such that the rear of the keyboard plate fits under the front edge of the computer, and the keyboard plate has an integral inclined rest surface substantially parallel to the front edge of the keyboard plate;

placing a copy support plate such that the back of the copy support plate resides against the first inclined surface of the riser support means and the bottom edge of the copy support plate resides against the keyboard plate to the rear of the inclined rest surface;

placing a keyboard on the keyboard plate between the inclined rest surface and the front edge of the keyboard plate;

placing a document against the top surface of the copy support plate; and adjusting the position of the keyboard plate to permit an appropriate thickness of a document to be held in place between the copy support plate and the inclined rest surface such that the document is held in a position in front of the monitor and behind the keyboard, so that the document can be viewed by the computer operator.

25. The method of claim 24 comprising the additional step of:

placing the keyboard plate on the work surface so that the front of the keyboard plate overhangs the work surface by approximately 1 to 4 inches, thereby creating an additional effective depth of the work surface and permitting room for the document to be held between the keyboard and the computer.

26. The method of claim 24 comprising the additional step of creating the integral inclined rest surface of the keyboard plate by sliding a removable tab into a groove located on the keyboard plate.

27. The method of claim 24 comprising the additional steps of providing a first groove in the copy support plate which is substantially parallel to a first edge;

placing the copy support plate such that the groove is located along the bottom edge of the copy support and a portion of the copy support plate overhangs a side edge of the keyboard plate; and inserting at least one tab into the groove such that an integral lip is created on the copy support plate along the bottom of the copy support plate to enable holding a document in place.

28. The method of claim 24 comprising the additional step of placing a second copy support plate such that the back of the second copy support plate resides at least partially against the front inclined surface of the first riser support means and the bottom edge of the copy support plate resides at least partially against the keyboard plate to the rear of the inclined rest surface, and such that the second copy support plate does not overlap the first copy support plate.

29. The method of claim 28 comprising the additional step of placing a third copy support plate between the second copy support plate and the first copy support plate.

30. An adjustable monitor riser and document holder for a computer workstation comprising a generally rectangular and planar keyboard plate having a length of approximately _18_ to _22_ inches, a width of approximately _3_ to _18_ inches, a thickness of approximately ⅛ to ¼", a front edge, a rear edge and a top surface such that approximately 2 to 4 inches of the rearmost top surface has a thickness of approximately ⅛ inch and is gently tapered to a lesser thickness at the rear edge;

a generally rectangular inclined rest surface integral to the keyboard plate the rest surface having a length substantially the length of the keyboard plate, having a width of approximately ½ to 2", being substantially parallel to the front and rear edges of the keyboard plate, being located approximately 9 to 12 inches from the front edge of the keyboard plate, such that a standard computer keyboard may be placed between the rest and the front edge of the keyboard plate, the rest surface being inclined toward the front edge of the keyboard plate at an angle of approximately 30 to 50 degrees with respect to the top surface of the keyboard plate;

a generally rectangular and planar copy support plate having a top surface, a bottom surface, a bottom edge, a thickness of approximately ⅛ to ¼", a height of approximately 9" to 11", and a width of approximately 9" to 11"; and at least one riser support having at least one inclined planar surface such that a portion of the bottom surface of the copy support plate rests against the inclined planar surface of the riser support and the bottom edge of the copy support plate rests against the top surface of the keyboard plate thereby creating a document holder.

31. A method of creating an in-line copy holder to hold various documents in place for viewing by a computer operator, the method comprising the steps of:

placing a stack of at least two riser support means on a work surface such that the stack has a first inclined planar surface presented toward the computer operator;

placing a computer monitor on top of the stack of riser support means such that the monitor faces the computer operator;

sliding a keyboard plate on top of the work surface such that the rear of the keyboard plate fits under the front edge of the stack of riser support means, and the keyboard plate has an integral inclined rest surface substantially parallel to the front edge of the keyboard plate;

placing at least two copy support plates such the back of each copy support plate resides against a portion of the inclined surface of the stack of riser support means and at least a portion of the bottom edge of each copy support plate resides against the keyboard plate to the rear of the inclined rest surface, and such that a lip is provided on the bottom edge of at least one copy support plate, such that the lip will support a document placed against the copy support plate;

placing a keyboard on the keyboard plate between the inclined rest surface and the front edge of the keyboard plate;

adjusting the position of the keyboard plate by pushing the plate towards the monitor for thin documents and pulling the plate towards the computer operator for thick documents; and placing at least one document against at least one copy support plate.

32. The method of claim 31 comprising the additional step of placing the keyboard plate so the front of the keyboard plate overhangs the work surface by approximately 1 to 4 inches, thereby creating an additional effective depth of the work surface and permitting room for the documents to be held between the keyboard and the monitor.

33. A combination keyboard holder, document holder, and monitor riser for a computer workstation comprising a substantially horizontal keyboard plate support means having a top surface, a bottom surface, a front edge, and a rear edge, such that the bottom surface of the keyboard plate may rest substantially upon a desk, table, or other support surface;

an upstanding tab integral to the top surface of the keyboard plate;

at least one riser support means having a front inclined planar surface, a top surface, and a bottom surface, such that a computer monitor may be placed upon a stack of one or more of the riser support means, and the riser support rests partially upon the rear portion of the keyboard plate, such that the weight of the riser support and the monitor tend to prevent movement of the keyboard plate; and a copy support plate having a top surface, a bottom surface, and a bottom edge, such that a portion of the bottom surface of the copy support plate rests against the front inclined planar surface of the riser support, and the bottom edge of the copy support plate rests against the top surface of the keyboard plate and the tab, and such that the tab serves as a lower support for a document or a keyboard placed upon the top surface of the copy support plate whereby the keyboard plate may be pulled away from said riser support means thereby creating a space between said tab and said copy support plate, when needed for thicker documents.

34. The combination keyboard holder, document holder, and monitor riser for a computer workstation of claim 33 wherein the keyboard plate extends horizontally beyond said support surface toward a user by approximately 1 to 4 inches, said keyboard plate being on substantially the same plane as said support surface, thereby creating additional effective space of the support surface and permitting room for working with papers between the tab and the front edge of the keyboard plate.

* * * * *